US010449119B2

(12) United States Patent
Scheffler et al.

(10) Patent No.: US 10,449,119 B2
(45) Date of Patent: Oct. 22, 2019

(54) DOSING STATION FOR A CAPSULE FILLING MACHINE

(71) Applicant: Fette Engineering GmbH, Schwarzenbek (DE)

(72) Inventors: Jan Fabian Scheffler, Hamburg (DE); Daniel Malick, Ahrensburg (DE); Afsaneh Nakhavoli, Hamburg (DE); Christian Pehlke, Geesthacht (DE); Jan-Eric Kruse, Seevetal (DE); Thomas Heinrich, Stelle (DE)

(73) Assignee: Fette Engineering GmbH, Schwarzenbek (DE)

( * ) Notice: Subject to any disclaimer, the term of this patent is extended or adjusted under 35 U.S.C. 154(b) by 1058 days.

(21) Appl. No.: 14/868,973

(22) Filed: Sep. 29, 2015

(65) Prior Publication Data

US 2016/0089302 A1 Mar. 31, 2016

(30) Foreign Application Priority Data

Sep. 29, 2014 (DE) ..... 10 2014 114 091

(51) Int. Cl.

| | |
|---|---|
| ***A61J 3/07*** | (2006.01) |
| ***B65B 1/04*** | (2006.01) |
| ***B65B 59/04*** | (2006.01) |
| ***B65B 3/00*** | (2006.01) |
| ***B65B 63/02*** | (2006.01) |

(Continued)

(52) U.S. Cl.

CPC ..... *A61J 3/074* (2013.01); *B65B 1/04* (2013.01); *B65B 1/24* (2013.01); *B65B 1/385* (2013.01); *B65B 3/003* (2013.01); *B65B 59/04* (2013.01); *B65B 63/022* (2013.01)

(58) Field of Classification Search

None

See application file for complete search history.

(56) References Cited

U.S. PATENT DOCUMENTS

| | | | | |
|---|---|---|---|---|
| 4,089,152 | A | 5/1978 | Zanasi | |
| 7,677,016 | B2 * | 3/2010 | Trebbi | A61J 3/074 53/253 |

(Continued)

FOREIGN PATENT DOCUMENTS

| | | |
|---|---|---|
| DE | 10 2006 014 496 A1 | 10/2007 |
| DE | 10 2007 031 856 A1 | 1/2009 |

(Continued)

*Primary Examiner* — Hemant Desai
*Assistant Examiner* — Tanzim Imam
(74) *Attorney, Agent, or Firm* — Young Basile Hanlon & MacFarlane, P.C.

(57) ABSTRACT

A dosing station for a capsule filling machine comprises a dosing unit in which capsule lower parts are filled with a filling material via a filling apparatus and a drive unit with at least one drive that drives at least one component of the dosing unit. The drive unit is arranged beneath a supporting plate, and detachable fastening and coupling means detachably fastens the dosing unit on the supporting plate. Where the dosing unit is detachably fastened on the supporting plate, the at least one drive is coupled to the at least one component. In the detached state of the dosing unit from the supporting plate, the coupling of the at least one drive to the at least one component is canceled. In this way, the dosing unit can be removed as a module from the dosing station.

16 Claims, 2 Drawing Sheets

(51) Int. Cl.
*B65B 1/24* (2006.01)
*B65B 1/38* (2006.01)

(56) References Cited

U.S. PATENT DOCUMENTS

| | | | | |
|---|---|---|---|---|
| 8,453,687 | B2 * | 6/2013 | Schmied | A61J 3/074 141/144 |
| 8,950,445 | B2 | 2/2015 | Schlipf et al. | |
| 2009/0232922 | A1 * | 9/2009 | Schlipf | A61J 3/074 425/150 |
| 2010/0281824 | A1 | 11/2010 | Ansaloni et al. | |

FOREIGN PATENT DOCUMENTS

| | | | |
|---|---|---|---|
| DE | 10 2010 019 997 | A1 | 11/2010 |
| EP | 1 512 632 | A2 | 3/2005 |
| GB | 1 205 371 | | 9/1970 |
| WO | 2005/112868 | A1 | 12/2005 |

* cited by examiner

DOSING STATION FOR A CAPSULE FILLING MACHINE

CROSS-REFERENCE TO RELATED APPLICATION

This application claims priority to German Patent Application No. 10 2014 114 091.5, filed Sep. 29, 2015, the content of which is incorporated herein in its entirety by reference.

FIELD OF THE DISCLOSURE

The invention relates to a dosing station for a capsule filling machine.

BACKGROUND

Hard gelatin capsules are filled with a filling material in capsule filling machines. The filling material can be, for example, in the form of a powder. Capsule filling machines have several process stations, which for example are started cyclically by capsule holders that hold the capsules or respectively capsule lower parts to be filled. Such capsule filling machines are also referred to as rotary capsule filling machines. As a rule, the process stations provided along the conveyor belt include a supply station for supplying the pre-sealed capsules to be filled, an opening station, in which the capsule halves are separated, one or more dosing stations, in which the material to be filled is filled in the capsule lower parts, a sealing station, in which the capsule halves are sealed and an ejection station, in which the produced capsules are ejected.

Frequently, several dosing stations are provided for a capsule filling machine, said dosing stations for example being allocated for different application purposes. Frequently, several different installation positions are provided in the capsule filling machine for the different dosing stations. Depending on the type of the respective dosing station to be used, a dosing station is then installed at different positions of the capsule filling machine.

From EP 1 512 632 B1, a dosing station designed as a trolley is known, wherein the trolley be can be completely removed from the capsule filling machine and exchanged for another trolley.

SUMMARY

A dosing station that is permanently installed in the capsule filling machine may be removed for cleaning, maintenance or in exchange for another dosing station of the same type. In the case of a switched off capsule filling machine, this removal is only possible by a successive, layer by layer disassembly of the dosing station and a corresponding successive, layer by layer reassembly. The corresponding disassembly and assembly expenditure as well as the downtimes for example in the event of product changes are high. The disassembly and assembly are additionally complicated by the fact that the dosing station is driven, as a rule, by the main drive of the capsule filling machine. This makes accessibility in the case of a permanently installed dosing station poor, a further result of which troubleshooting is also more difficult. Due to the high weight of the individual components the exchange of the dosing stations is further complicated.

In the removable trolley forming the dosing station in EP 1 512 632 B1, a drive of the dosing station is arranged in a base cabinet and must be coupled to the remaining components of the capsule filling machine in burdensome manner in the case of a restarting. This also holds true for the exchange of signals necessary in the case of a restarting of the dosing station. The positioning of the trolley on the capsule filling machine is expensive and requires increased installation space. Increased costs arise, not least due to the requirement for twice the parts, e.g., a drive, rack, etc. In addition, there is the risk of an increased susceptibility to errors due to the increased number of parts, such as for example pivotable doors on the capsule filling machine, a base cabinet for the drive, doors on the base cabinet, a hub system for the trolley, etc.

In contrast, the present invention provides a dosing station whose structure and/or its exchange for another dosing station is simplified.

According to the teachings herein, a dosing station has a dosing unit and a drive unit. The drive unit is arranged beneath a supporting plate, and the dosing unit is arranged on the supporting plate. Detachable fastening and coupling means are provided, with which the dosing unit is detachably fastenable on the supporting plate. In the case where the dosing unit is detachably fastened on the supporting plate by means of the fastening and coupling means, the drive unit is coupled to a component driven by the drive unit. In the detached state of the dosing unit (i.e., when the dosing unit is detached from the supporting plate), the coupling of the drive unit to the component driven by drive unit is canceled so that the dosing unit can be removed as a module from the dosing station.

The dosing station is provided for a capsule filling machine. The capsule filling machine serves the purposes of filling and sealing capsules composed of a capsule upper part and a capsule lower part, for example hard gelatin capsules. The capsule filling machine generally comprises a plurality of process stations arranged along a preferably circular conveyor path and a plurality of capsule conveying apparatuses, each of which has a plurality of capsule holders for holding one capsule each or one capsule half each. The capsule conveying apparatuses convey held capsules along the conveyor path through the process stations. As initially mentioned, such capsule filling machines are also referred to as rotary capsule filling machines. Different process stations are provided along the conveyor path, in particular a supply station for supplying the pre-sealed capsules to be filled, an opening station, in which the capsule halves are separated, one or more dosing stations, in which the material to be filled is filled in the capsule lower parts, a sealing station, in which the capsule halves are sealed, and an ejection station, in which the produced capsules are ejected. In addition, several empty stations are frequently provided that can be used in different ways depending on the application purpose.

The teachings herein describe the dosing station and its integration into the capsule filling machine. The dosing station is divided into a dosing unit and a drive unit. In particular, it can consist exclusively of the dosing unit and the drive unit, thus comprising no further units. Alternatively, the dosing can include further units. The filling material is dosed in the dosing unit and transferred to the capsule lower parts. To this end, the dosing unit has a filling apparatus. One or more components of the dosing unit are driven by one or more drives of the drive unit coupleable to the dosing unit. The at least one drive of the drive unit can be a different drive than the main drive of the capsule filling machine. Thus, the drive unit can provide a separate drive that serves only the purpose of driving the at least one component of the dosing unit. The drive unit is arranged beneath a supporting plate. The drive unit can be fastened to the supporting plate. The dosing unit is arranged on the supporting plate for coupling the dosing unit to the drive unit and is fastened to the supporting plate by means of the detachable fastening and coupling means. In operation, at least one drive of the drive unit is coupled to at least one component of the dosing unit driven thereby, and the dosing station can be operated together with the capsule filling machine. To remove the dosing unit or exchange the dosing unit for another dosing unit, the detachable fastening and coupling means is detached. Namely, the coupling of at least one drive to at least one component of the dosing unit driven thereby is canceled, and the dosing unit can be removed as a module or as a total package from the dosing station and, for example, be exchanged for another dosing unit likewise forming such a module. In the removal or replacement process, the drive unit with the at least one drive remains in the capsule filling machine.

The coupling of the at least one drive to the at least one component driven by the at least one drive in the case of the placement of the dosing unit on the supporting plate can take place in particular automatically in the course of the fastening by means of the fastening and coupling means. Correspondingly, the decoupling of the at least one drive from the at least one component driven by the at least one drive can likewise take place in particular automatically in the course of the detachment of the fastening and coupling means in the case of the lifting of the dosing unit from the supporting plate. The module-like design of the dosing unit and the simple coupling to the drive unit via the supporting plate as well as the detachable fastening and coupling means allow, in comparison to the prior art, in simplified manner a removal of the dosing unit from the capsule filling machine and a re-insertion of the removed dosing unit or of another dosing unit.

Hence, by means of the dosing station according to embodiments of the invention, a reduced installation or removal expenditure is achieved. A rapid product change is possible by means of a rapid change of the dosing unit and, as a result, a cost savings is possible. In particular, a reserve module of the dosing unit can be maintained. Downtimes are reduced. In particular, no disassembly whatsoever of individual parts of the dosing unit is necessary for removal from the capsule filling machine, but rather the dosing unit is removed as a whole package. The accessibility, in particular in the removed state, is improved vis-à-vis the previously described art, so that installation errors are reduced and troubleshooting is improved. Handling is simplified through the improved accessibility and the simple alignment and positioning of the parts to one another. Also, inspection in the disassembled state is simplified. This also holds true for cleaning. In addition, a high flexibility is achieved. Only the supporting plate remains in the capsule filling machine with the drive unit located below, without further disturbing components. Due to the omission of a trolley or a base cabinet, a compact, space-saving and cost-saving construction is achieved.

After detachment of the fastening and coupling means, the dosing unit can be taken out of the capsule filling machine with a mechanical device or swiveled out and, for example, temporarily stored on an equipment truck and secured or otherwise fixed there.

Preferably the dosing unit is fastened on an installation plate, wherein the dosing unit can be arranged with the installation plate on the supporting plate. Then, in the arrangement on the supporting plate, the dosing unit is detachably fastenable by means of the detachable fastening and coupling means on the supporting plate. The dosing unit can be removed as a module from the dosing station with the installation plate in the detached state from the supporting plate. In particular, the installation plate can be detachably fastenable on the supporting plate by means of the detachable fastening and coupling means. The installation plate forms the basis for the dosing unit forming a module. As a result, installation and removal are further facilitated.

In principle, the fastening of the dosing unit on the supporting plate can be realized non-positively (for example by means of screws, pins, springs, pneumatic means) and/or positively (for example by means of coupling, gears, bayonet mount). In accordance with one preferred embodiment, the detachable fastening and coupling means comprise first clamping means, such as one or more first clamping pins, with which the installation plate is clamped with the supporting plate in the state of being arranged on the supporting plate. The dosing unit is aligned in the removal state by means of an auxiliary device so that an exact positioning for the (re)installation, in particular with regard to height and angular position, is ensured. The installation plate is firmly clamped with the supporting plate by means of the first clamping means. The first clamping means can simultaneously be used for positioning the dosing unit or respectively for its alignment for the installation. The retaining force of the clamping means for fixation of the dosing unit can be produced mechanically, pneumatically, magnetically or otherwise.

According to a further embodiment provision can be made that the detachable fastening and coupling means comprises one or more first clamping pins fastened on the installation plate or on the supporting plate, which in the case of placement of the installation plate on the supporting plate preferably self-locks or respectively self-lock in one or more mechanically closing clamping holder(s) fastened in the other of the supporting plate or installation plate. In addition, provision can be made that the clamping holders each comprise a clamping slide mounted axially displaceable transverse to the insertion direction of the respective clamping pin into the clamping holder. The clamping slide is pre-stressed in a locking position, in which the clamping slide engages in locking manner into a peripheral groove of a clamping pin inserted respectively into the clamping holder. In the case of these embodiments, one or more first clamping pins fastened on the installation plate or on the supporting plate are provided. If the first clamping pin or clamping pins are provided on the installation plate, one or more mechanically closing clamping holders are provided on the supporting plate. On the other hand, if the first clamping pin or clamping pins are designed on the supporting plate, the mechanically closing clamping holder(s) are correspondingly provided on the installation plate. To facilitate positioning, the clamping pin or clamping pins can be tapered, in particular conically tapered, on their free end facing the clamping holder. Thus, a self-centering of the dosing unit takes place in the course of placement on the supporting plate. The clamping pins preferably self-lock in the mechanically closing clamping holders, so that the installation plate and with it the dosing unit is securely held on the supporting plate. The clamping holders can in each case comprise a clamping slide mounted axially displaceable transverse to the insertion direction of the clamping pins into the clamping holders. The clamping slide can, for example, be pre-stressed by means of a spring preload into a locking position protruding into the insertion path of the respective clamping pin. If a clamping pin is located in the clamping holder, the clamping slide engages in the locking position with its free end into a peripheral groove constructed in the respective clamping pin, so that the clamping pin is preferably self-locked in the clamping holder.

The clamping slides of the clamping holders can for example be pneumatically movable against their preload from the locking position into an unlocking position releasing a respective clamping pin. The unlocking of the clamping pins and thus the detachment of the installation plate with the dosing unit from the supporting plate can be triggered manually or automatically, for example by means of a switch.

If the unlocking takes place pneumatically, the clamping slide is pressed into its unlocking position by means of the introduction of compressed air into an air chamber and with this its respective clamping pin is released. The movement of the clamping slide into the unlocking position can take place by means of a piston actuated by means of the compressed air. The movement of the clamping slide from the locking position into the unlocking position can also occur for example hydraulically, mechanically or by a motor.

At least one drive of the drive unit can be a rotary drive, which is coupleable with a rotationally driven component of the dosing unit. The detachable fastening and coupling means can comprise preloading means, preferably spring preloading means, which in the case of placement of the dosing unit on the supporting plate press a drive shaft of the rotary drive against the rotationally driven component of the dosing unit.

The rotary drive and/or the drive shaft of the rotary drive can be float mounted in the axial direction of the drive shaft. The axial floating support of the rotary drive or of its drive shaft can in particular only allow a movement in axial direction of the drive shaft. The drive shaft of the rotary drive can in particular be pressed against a support shaft supporting the dosing disk. In this case, by means of the preloading means in combination with an axial floating support of the rotary drive or of the drive shaft, and if necessary in combination with the first clamping means clamping the dosing unit or respectively the installation plate with the supporting plate, the required friction torque for the power transmission between the rotary drive or respectively its drive shaft and the rotationally driven component is achieved.

A spring assembly providing the spring preload on the one hand produces the required counterforce and on the other hand produces a required travel of the rotary drive or of its rotary drive shaft, in order if necessary to compensate a length tolerance and/or thermal expansion of the drive elements. For example, in the case of a removed dosing unit, a drive shaft of the rotary drive can be positioned with a defined projection past the surface relative to the upper side of the supporting plate. By means of placement of the dosing unit, the rotationally driven component or respectively a support shaft bearing said component is pressed for example by the first clamping means on the rotary drive or respectively its drive shaft in connection with the preloading means. As a result, the projection past the surface of the rotary drive or respectively of its drive shaft beyond the upper side of the supporting plate is surmounted. The spring path of the spring preloading means can correspond to this very difference in height.

According to another embodiment, an intermediate element increasing the friction coefficient can be arranged on the interface between the drive shaft of the rotary drive and the rotationally driven component or respectively a support shaft bearing said component, preferably a diamond disk.

In addition, an anti-turn device can be provided, which prevents a turning of the rotary drive.

According to another embodiment, provision can be made that the component of the dosing unit rotationally driven by the rotary drive is a dosing disk with at least a group of boreholes and that the dosing unit further comprises at least a group of filling punches and a group of ejecting punches, wherein the filling punches and the ejecting punches are held on a punch support vertically moveable by at least one lifting drive of the drive unit. By means of vertical movement of the punch support, the filling punches for pressing the filling material into the boreholes and the ejecting punches for ejection of pellets produced by the filling punches in the boreholes can enter into the boreholes. In the case of this embodiment, the dosing station is thus a filling punch station. As an alternative, of course, other dosing stations are also conceivable, for example pipette stations, pellet or tablet filling stations or roll filling stations.

According to another embodiment, provision can be made that the detachable fastening and coupling means additionally comprises second clamping means, preferably at least a second clamping pin, with which the at least one lifting drive or at least one lifting element connected to the at least one lifting drive can be optionally clamped with at least one lifting element engaging on the punch support or can be detached from the at least one lifting element engaging on the punch support. The lifting drives can for example be spindle drives. Correspondingly, the at least one lifting element connected to the at least one lifting drive and/or the at least one lifting element engaging on the punch support can be a spindle of such a spindle drive. The spindle runs for example in a spindle nut rotating with the rotary drive, but axially stationary connected to the rotary drive. For example, two lifting drives can be provided which engage on opposite sides of the punch support. Through the aforementioned embodiment of lifting elements that are detachable from one another, also in this respect, a simple separation of the dosing unit from the drive unit is realized. The connection of the lifting elements to one another can take place both non-positively (for example by screws, pins, springs, pneumatic cylinders) as well as also positively (for example by means of a coupling) or in combination. For example the second clamping pins of the second clamping means can be formed by tie rods, which are guided through the lifting elements to be combined with one another and are screw-mountable in at least one of the lifting elements to be combined with one another.

Additionally, an anti-turn device can be provided that prevents a turning of the at least one lifting drive and/or of the at least one lifting element connected to the at least one lifting drive in the detached state from the at least one lifting element engaging on the punch support. The at least one lifting element engaging on the punch support can be axially guided in at least one guide column firmly arranged on the dosing unit. Alternatively or additionally, the at least one lifting element connected to the at least one lifting drive can be axially guided in at least one guide column firmly arranged on the drive unit. By means of the anti-turn device an uncontrolled rotation of the lifting elements is prevented, in particular in a state where the dosing unit and the drive unit are separated from one another. The guide columns can simultaneously have suitable bearings for the lifting elements.

According to another embodiment, provision can be made that at least one spacer engaging on the punch support or the at least one lifting element engaging on the punch support is provided, which prevents an uncontrolled lowering of the punch support after a detachment of the at least one lifting drive and/or of the at least one lifting element firmly connected to the at least one lifting drive from the at least one lifting element engaging on the punch support. The spacers prevent an uncontrolled lowering of the punch support after the separation of the lifting elements from one another or respectively of the dosing unit from the drive unit. For example, clamps or the like can be provided as spacers.

The invention also relates to a capsule filling machine for filling and sealing of capsules composed of a capsule upper part and a capsule lower part, comprising one or more dosing stations described herein. If the capsule filling machine comprises several dosing stations, they can be identical to one another in design or different.

In the following exemplary embodiments of the invention will be explained more closely with the assistance of figures.

BRIEF DESCRIPTION OF THE DRAWINGS

Unless otherwise specified, in the figures identical reference numbers refer to identical objects.

DETAILED DESCRIPTION

Figure 1:
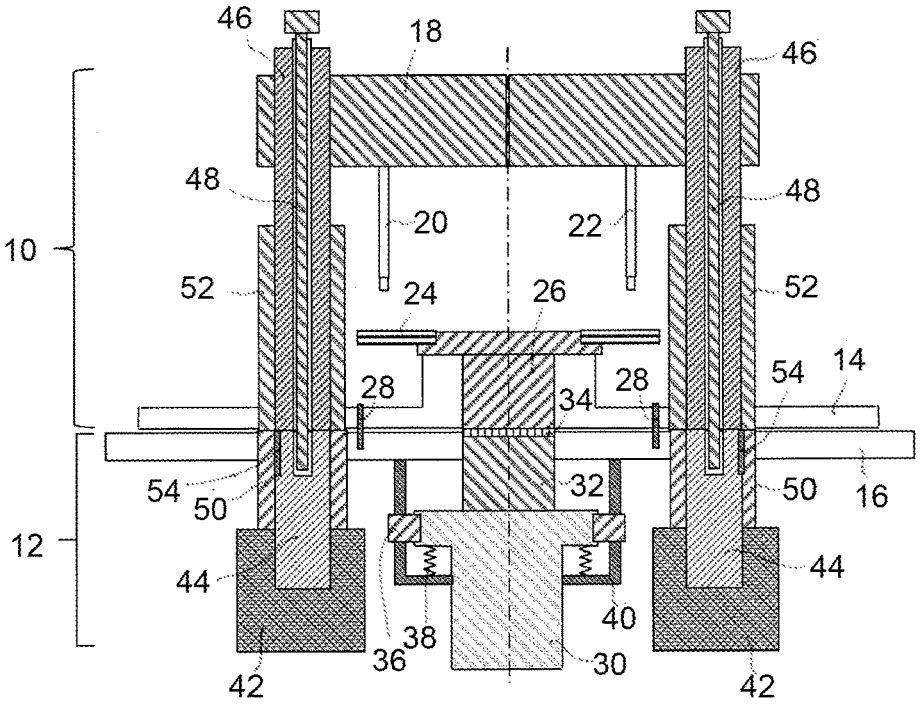
FIG. 1 is a sectional view of a dosing station according to the teachings herein in a first operating state.
Figure 2:
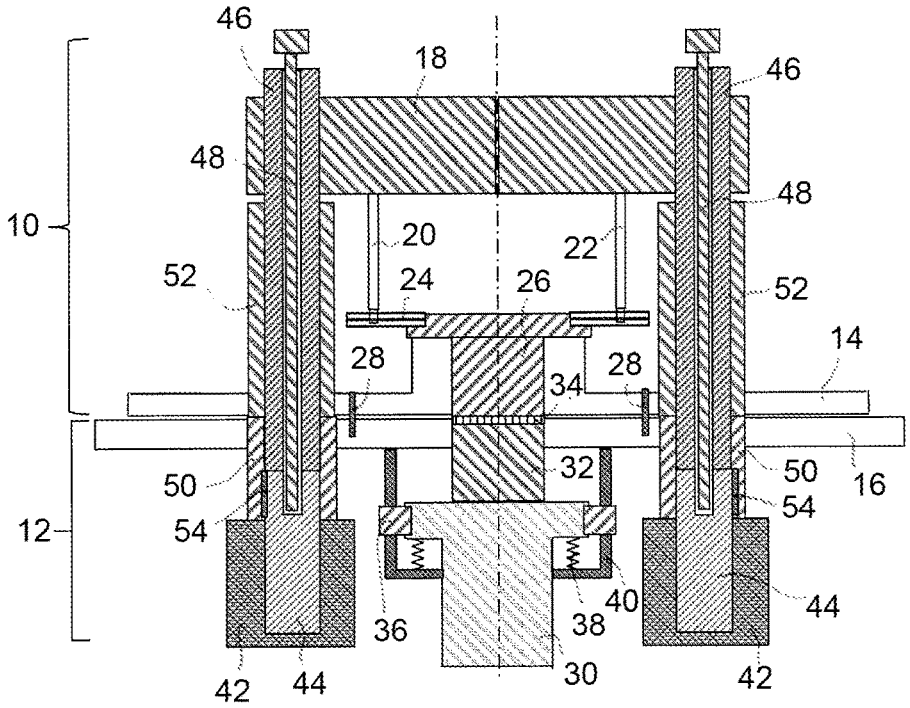
FIG. 2 is a sectional view of the dosing station from FIG. 1 in a second operating state.
Figure 3:
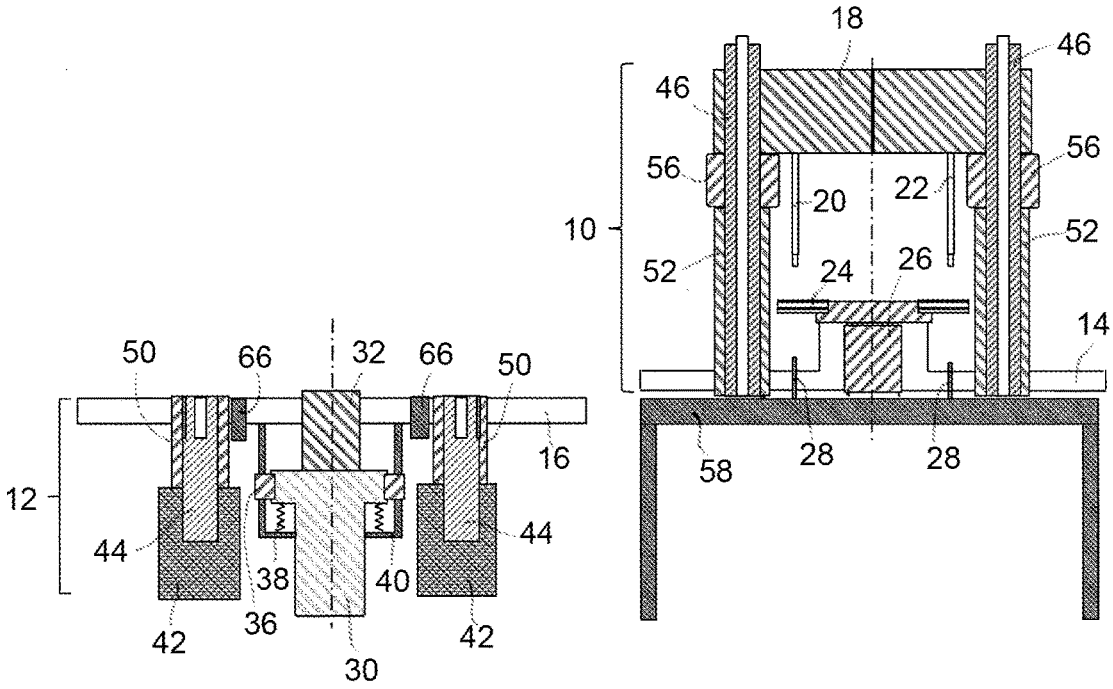
FIG. 3 is a sectional view of the dosing station from FIG. 1 in a third operating state.

The dosing station shown in FIGS. 1 to 3 is provided for use in a capsule filling machine for filling and sealing capsules composed of a capsule upper part and a capsule lower part. The dosing station comprises a dosing unit shown generally in the figures with reference number 10, in which capsule lower parts supplied to the dosing station are filled with filling material via a filling apparatus not shown in greater detail. In addition the dosing station comprises a drive unit shown generally in FIGS. 1 to 3 with reference number 12. The dosing unit 10 is arranged and fastened on an installation plate 14, for example screwed or otherwise fastened. The drive unit 12 is arranged beneath a supporting plate 16 and fastened on the supporting plate 16, likewise for example being screwed or otherwise fastened.

The dosing unit 10 comprises a punch support 18, which bears at least one group of filling punches 20 and at least one group of ejecting punches 22. The dosing unit 10 further has a dosing disk 24 with one or more groups of boreholes. The dosing disk 24 is annular in design and is held by a support shaft 26. In FIGS. 1 and 2, the dosing unit 10 is clamped with its installation plate 14 in a manner to be explained in greater detail below by first clamping means 28 of detachable fastening and coupling means with the supporting plate 16 and thus with the drive unit 12.

The drive unit 12 comprises a rotary drive 30, for example an electric motor, which is coupled to a drive shaft 32. In the clamped state via the first clamping means 28 in FIGS. 1 and 2, the dosing disk 24 is pressed with its support shaft 26 against the drive shaft 32 of the rotary drive 30. To increase the friction coefficient, a diamond disk 34 is arranged between the support shaft 26 and the drive shaft 32. Reference number 36 shows an anti-turn device for the rotary drive 30. A spring assembly 40 provided with springs 38 presses the rotary drive 30 with the drive shaft 32 float mounted in axial direction of the drive shaft 32 upward against the support shaft 26 in FIGS. 1 and 2. In the state shown in FIGS. 1 and 2, frictional engagement exists between the drive shaft 32 and the support shaft 26, so that the dosing disk 24 can be rotationally driven by the rotary drive 30.

The drive unit 12 comprises, in addition, two lifting drives shown generally in the represented example with reference number 42, which for example likewise comprise electric motors. In the represented example, the electric motors of the lifting drives 42 drive an axially fixed, but pivoted spindle nut not represented in greater detail, in which a spindle 44 is guided in axially movable fashion. In the case of rotation of the spindle nut driven by the respective electric motor, the spindle 44 is hence moved up or down in vertical direction.

In the represented example two lifting sleeves 46 are fastened on the punch support 18, each of which are connected to the spindles 44 by a tie rod 48 each in the state shown in FIGS. 1 and 2 such that an axial movement of the spindles 44 via the lifting sleeves 46 leads to a corresponding axial movement of the punch support 18 with the punches 20, 22. In FIG. 1 a retracted state of the punches 20, 22 from the boreholes of the dosing disk 24 is shown, while in FIG. 2 the punches 20, 22 are inserted downward into the boreholes of the dosing disk 24 by means of a vertical movement of the punch support 18. Each of the spindles 44 are mounted in guide columns 50 firmly connected to the drive unit 12 and axially guided. The lifting sleeves 46 are correspondingly each guided and mounted in guide columns 52 firmly connected to the dosing unit 10. In each case an anti-turn device 54 prevents a turning of the lifting drives 42 in a detached state from the lifting sleeves 46 of the punch support 18.

To remove the dosing unit 10 on the one hand the tie rods 48 are detached, so that the lifting sleeves 46 are no longer connected to the spindles 44 of the lifting drives 42. To prevent an uncontrolled lowering of the punch support 18, in FIG. 3 spacers represented by reference number 56, in this case clamps, are mounted on the lifting sleeves 46 between the punch support 18 and the guide columns 52. Moreover, the first clamping means 28 are detached. By means of a mechanical auxiliary device the dosing unit 10 with its installation plate 14 can be detached from the supporting plate 16 in this detached state and from the drive unit 12 by lifting and, for example swiveling out, and can be placed on an equipment change truck 58 shown in FIG. 3. In the left part of the image of FIG. 3 it can be recognized that in the detached state of the dosing unit 10 the drive shaft 32 of the rotary drive 30 is pressed upward in the axial direction by the spring assembly 40 with its springs 38, so that the drive shaft 32 protrudes beyond the upper side of the supporting plate 16. For a new installation of the dosing unit 10 it is for example placed with the installation plate 14 again by means of the mechanical auxiliary device on the supporting plate 16 and clamped on the supporting plate 16 by means of the first clamping means 28. In the installation process the drive shaft 32 and with it the rotary drive 30 are again pressed downward against the preloading of the springs 38 of the spring assembly 40. Subsequently, the tie rods 48 are fastened through the lifting sleeves 46 in the spindles 44, for example by means of screwing. Then the capsule filling machine can be put back into operation.

Figure 4:
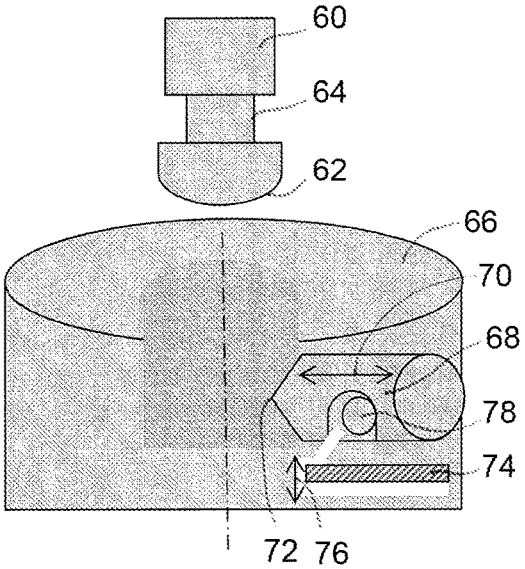
FIG. 4 is a partially transparent view of a part of the detachable fastening and coupling means of the dosing station shown in FIG. 1.

With the aid of FIG. 4 the first clamping means 28 is to be explained in greater detail. The first clamping means 28 each has a first clamping pin, which is shown in FIG. 4 with reference number 60. The other first clamping pin 60 of the first clamping means 28 is identical in design, so that in the following the first clamping pin 60 shown in FIG. 4 will be explained as an example. The first clamping pin 60 tapers on its free end 62. Reference number 64 is a peripheral groove of the first clamping pin 60. The reference number 66 denotes a clamping holder, which for example is also schematically represented in the left graphic component of FIG. 3. One clamping holder is provided for each first clamping pin 60. In the course of placing the dosing unit 10 with the installation plate 14 on the supporting plate 16, the first clamping pins 60 are inserted into the clamping holders 66, wherein the tapered free end 62 leads to an automatic centering. Subsequently the identically designed clamping holders will be explained by way of example with the aid of the clamping holder 66 shown in FIG. 4.

In the course of insertion into the clamping holders 66, a clamping slide 68 axially displaceable along the arrow 70 represented in FIG. 4 locks into position with its tip 72 into the peripheral groove 64 of the respective clamping pin 60. To this end the clamping slide 68 is preloaded for example by spring preload into a locking position protruding into the insertion path of the clamping pin 60. In this way in an especially simple manner a self-locking of the clamping pin 60 in the clamping holder 66 takes place and thus a clamping of the dosing unit 10 with the installation plate 14 on the drive unit 12 with the supporting plate 16. For detachment, for example an unlocking piston 74 along the arrow 76 can be pneumatically actuated by compressed air. As a result a locking bolt 78 can be triggered, which presses the clamping slide 68 out against its spring preload out of the peripheral groove 64 of the clamping pin 60, so that the clamping pin 60 and thus the dosing unit 10 can be detached with its installation plate 14 from the supporting plate 16.

What is claimed is:

1. A dosing station for a capsule filling machine for filling and sealing capsules composed of a capsule upper part and a capsule lower part, the dosing station comprising:

a dosing unit in which the capsule lower parts are filled with a filling material via a filling apparatus;

a drive unit with a drive that drives a component of the dosing unit; and detachable fastening and coupling means, wherein:

the drive unit is arranged beneath a supporting plate, the dosing unit has a coupled state wherein the detachable fastening and coupling means detachably fastens the dosing unit to the supporting plate and the drive is coupled to the component driven by the drive, and the dosing unit has a detached state in which the dosing unit is detached from the supporting plate such that coupling of the drive to the component driven by the drive is canceled, so that the dosing unit can be removed as a module from the dosing station.

2. The dosing station according to claim 1, wherein:

the dosing unit is fastened on an installation plate, the dosing unit is arranged with the installation plate on the supporting plate in the coupled state, and the dosing unit is removed as a module from the dosing station together with the installation plate in the detached state.

3. The dosing station according to claim 2, wherein the detachable fastening and coupling means comprises at least one clamping pin with which the installation plate is clamped to the supporting plate in the coupled state of the dosing unit.

4. The dosing station according to claim 2, wherein the detachable fastening and coupling means comprises at least one clamping pin fastened on one of the installation plate or the supporting plate, wherein in the case of placement of the installation plate on the supporting plate, the at least one clamping pin locks in a respective clamping holder fastened on the other of the supporting plate or the installation plate.

5. The dosing station according to claim 4, wherein each clamping holder comprises a clamping slide mounted to be axially displaceable transverse to an insertion direction of a respective clamping pin into the clamping holder, wherein the clamping slide is pre-stressed in a locking position in which the clamping slide engages in locking manner a peripheral groove of the respective clamping pin inserted into the clamping holder.

6. The dosing station according to claim 5, wherein the clamping slide of the clamping holder is pneumatically movable against its preload from the locking position into an unlocking position releasing the respective clamping pin.

7. The dosing station according to claim 1, the drive of the drive unit is a rotary drive coupleable with a rotationally driven component of the dosing unit.

8. The dosing station according to claim 7, wherein the detachable fastening and coupling means comprises spring preloading means, and wherein, in the event of placement of the dosing station on the supporting plate, the spring preloading means presses a drive shaft of the rotary drive against the rotationally driven component of the dosing unit.

9. The dosing station according to claim 8, wherein at least one of the rotary drive or the drive shaft of the rotary drive is float mounted in an axial direction of the drive shaft.

10. The dosing station according to claim 8, further comprising:

an intermediate element increasing a friction coefficient arranged on an interface between the drive shaft and the rotationally driven component.

11. The dosing station according to claim 7, wherein the rotationally driven component of the dosing unit rotationally driven by the rotary drive is a dosing disk with boreholes, and wherein the dosing unit further comprises:

filling punches for pressing the filling material into the boreholes; and ejecting punches for ejection of pellets produced by the filling punches, wherein:

the filling punches and the ejecting punches are held on a punch support vertically moveable by a lifting drive of the drive unit, and vertical movement of the punch support causes the filling punches and the ejecting punches to enter into the boreholes.

12. The dosing station according to claim 11, wherein the detachable fastening and coupling means comprises:

first clamping means, with which the dosing unit is clamped to the supporting plate in the coupled state; and second clamping means, with which at least one of the lifting drive or a lifting element connected to the lifting drive is detachably clamped to a lifting sleeve on the punch support when the dosing unit is in the coupled state.

13. The dosing station according to claim 12, further comprising:

an anti-turn device that prevents a turning of the at least one of the lifting drive or the lifting element when the dosing unit is in the detached state.

14. The dosing station according to claim 12, wherein at least one of:

the lifting sleeve on the punch support is axially guided in a guide column firmly arranged on the dosing unit; or the lifting element connected to the lifting drive is axially guided in a guide column firmly arranged on the drive unit.

15. The dosing station according to claim 12, further comprising:

at least one spacer on the punch support or the lifting sleeve, the at least one spacer preventing an uncontrolled lowering of the punch support after a detachment of at least one of the lifting drive or the lifting element from the lifting sleeve.

16. A capsule filling machine for filling and sealing capsules composed of a capsule upper part and a capsule lower part, the capsule filling machine comprising one or more dosing stations according to claim 1.

* * * * *